US007049764B2

(12) United States Patent
Park

(10) Patent No.: US 7,049,764 B2
(45) Date of Patent: May 23, 2006

(54) ELECTRODELESS LIGHTING APPARATUS USING MICROWAVE AND METHOD FOR CONTROLLING POWER THEREOF

(75) Inventor: Chang-Sin Park, Gyeongsangbuk-Do (KR)

(73) Assignee: LG Electronics Inc., (KR)

( * ) Notice: Subject to any disclaimer, the term of this patent is extended or adjusted under 35 U.S.C. 154(b) by 0 days.

(21) Appl. No.: 10/768,626

(22) Filed: Jan. 29, 2004

(65) Prior Publication Data

US 2005/0035721 A1 Feb. 17, 2005

(30) Foreign Application Priority Data

Aug. 14, 2003 (KR) ..... 10-2003-0056511

(51) Int. Cl.
*H05B 41/16* (2006.01)
*H05B 6/04* (2006.01)

(52) U.S. Cl. ..... 315/248; 315/267; 315/246; 315/344; 219/660; 219/661; 219/663

(58) Field of Classification Search ..... 315/248, 315/267, 246, 344; 219/660, 661, 663, 702, 219/707, 715, 716, 760, 761
See application file for complete search history.

(56) References Cited

U.S. PATENT DOCUMENTS 5,115,168 A * 5/1992 Shoda et al. ..... 315/223
6,265,830 B1 * 7/2001 Bretmersky et al. ..... 315/106
6,577,074 B1 * 6/2003 Ervin et al. ..... 315/248

* cited by examiner

*Primary Examiner*—Tuyet Thi Vo
(74) *Attorney, Agent, or Firm*—Ostrolenk, Faber, Gerb & Soffen, LLP

(57) ABSTRACT

An electrodeless lighting apparatus using microwave and a method for controlling its power can lengthen lifetimes of the magnetron by constantly maintaining power applied to a magnetron of the electrodeless lighting apparatus using microwave. Therefore, when inputted AC voltage is changed, and thus oscillation current applied to a filament of the magnetron is changed, a rate of variability of voltage of the inputted AC power is compensated so that voltage and current applied to the magnetron is constantly maintained.

2 Claims, 2 Drawing Sheets

ELECTRODELESS LIGHTING APPARATUS USING MICROWAVE AND METHOD FOR CONTROLLING POWER THEREOF

BACKGROUND OF THE INVENTION

1. Field of the Invention

The present invention relates to a lighting apparatus, and particularly to an electrodeless lighting apparatus using microwave.

2. Description of the Background Art

Recently, a lighting apparatus having an electrodeless light bulb using microwave wave has been developed. Since the electrodeless light apparatus has a long lifetimes and excellent light-emitting efficiency, a use thereof is being gradually increased. Hereinafter, an electrodeless lighting system according to the conventional art will now be described with reference to FIG. 1.

FIG. 1 is a view illustrating a structure of an electrodeless lighting apparatus using microwave according to the conventional art.

As shown in FIG. 1, an electrodeless lighting apparatus using microwave includes a power unit 10 for supplying AC power; a high voltage transformer (HVT) 13 for converting the AC power into a DC power of high voltage, and outputting the converted DC power of high voltage; a magnetron 14 receiving the DC power of high voltage and generating microwave; a waveguide 16 for inducing the microwave generated from the magnetron 14; an electrodeless light bulb 15 for emitting light by the induced microwave; a resonator 17 for cutting off the microwave by covering the front of the electrodeless light bulb 15, and passing the light emitted from the electrodeless light bulb 15 therethrough; and a cooling unit for cooling heat generated from the magnetron 14 and the high voltage transformer (HVT) 13. Hereinafter, operations of the electrodeless lighting apparatus using microwave according to the conventional art will now be described.

First, the HVT 13 converts AC power outputted from the power unit 10 into AC power of high voltage, converts the converted AC power into DC power, and outputs the converted DC power of high voltage to the magnetron 14.

The magnetron 14 receives the DC power of high voltage and generates microwave. Herein, the microwave is induced to the electrodeless light bulb 15 through the waveguide.

The electrodeless light bulb 15 generates light by the induced microwave. Herein the light is frontwardly emitted by a reflector 18.

Hereinafter, a structure of a voltage doubler unit of the HVT 13 will now be described with reference to FIG. 2.

FIG. 2 is a view illustrating a structure of a voltage doubler unit of the HVT according to the conventional art.

As shown therein, a voltage doubler unit within the high voltage transformer (HVT) 13 includes a first circuit unit 21 for converting AC power of high voltage generated from the HVT 13 into DC power of high voltage for the half of one period; and a second circuit unit 22 for converting AC power of high voltage generated from the HVT 13 into DC power of high voltage for another half of one period.

The first circuit unit 21 includes one side of a first capacitor (C1) connected to an output terminal of one side of the HVT 13; a (−) terminal of a first diode (D1) connected to the other side of the first capacitor (C1); and a (+) terminal of a third diode (D3) connected to the other side of the first capacitor (C1).

The second circuit unit 22 includes one side of a second capacitor (C2) connected to an output terminal of the other side of the HVT 13; a (−) terminal of a second diode (D2) connected to the other side of the second capacity (C2); and a (+) terminal of a fourth diode (D4) connected to the other side of the second capacitor (C2). Herein, the (+) terminal of the first diode (D1) and the (+) terminal of the second diode (D2) are connected to each other. That is, the voltage doubler unit is formed in a mirror type based on the earth of the HVT 13, and consists of circuits which are operated for different periods.

For example, for the half of one period, the first circuit unit 21 is operated to rectify AC power (voltage/current) corresponding to the half of one period for the half of one period, the second circuit unit 22 is operated to rectify AC power corresponding another half of one period for another half of one period.

However, in the high voltage transformer 13 of the electrodeless lighting apparatus using microwave according to the conventional art, when AC voltage inputted from the power unit 10 is changed (for example, when an instantaneous voltage change occurs), current which is applied to a filament of the magnetron 14 through the high voltage transformer 13 and the voltage doubler unit is changed, thereby shortening lifetimes of the magnetron. For example, if inputted voltage is change, outputted high voltage and current applied to a filament (cathode of magnetron) of the magnetron 14 are changed, and thus the magnetron 14 is put in an unstable state, thereby shortening lifetimes of the magnetron 14.

Besides, a lighting apparatus using microwave according to different conventional arts is described in detail in U.S. Pat. No. 6,608,443 registered on Aug. 19, 2003, U.S. Pat. No. 6,633,130 registered on Oct. 14, 2002 and U.S. Pat. No. 6,351,087 registered on Feb. 26, 2002.

SUMMARY OF THE INVENTION

Therefore, an object of the present invention is to provide an electrodeless lighting apparatus using microwave and a method for controlling its power capable of lengthening lifetimes of a magnetron by constantly maintaining voltage and current applied the magnetron when inputted AC voltage is changed, and thus current supplied to a filament of the magnetron is changed.

To achieve these and other advantages and in accordance with the purpose of the present invention, as embodied and broadly described herein, there is provided an electrodeless lighting apparatus using microwave including means for constantly maintaining voltage and current applied to the magnetron by compensating a rate of variability of inputted AC voltage when oscillation current applied to a filament of a magnetron is varied due to a change of the inputted AC voltage.

To achieve these and other advantages and in accordance with the purpose of the present invention, as embodied and broadly described herein, there is provided an electrodeless lighting apparatus using microwave including a power controlling unit for detecting a rate of variability of voltage of inputted AC power, generating fixed AC voltage and current by compensating the detected rate of variability of the voltage. Herein, a magnetron of the electrodeless lighting apparatus generates microwave based on the fixed AC voltage and the current.

To achieve these and other advantages and in accordance with the purpose of the present invention, as embodied and broadly described herein, there is provided an electrodeless lighting apparatus using microwave including a power controlling unit for detecting a rate of variability of an inputted AC power, and generating fixed AC voltage and fixed oscillation current by compensating the rate of variability of the voltage; a high voltage transformer for converting the fixed AC voltage into high DC voltage, and outputting the converted high DC voltage; and a magnetron for generating microwave based on the fixed oscillation current and the DC voltage of the high voltage To achieve these and other advantages and in accordance with the purpose of the present invention, as embodied and broadly described herein, there is provided a power controlling unit of a lighting apparatus using microwave including a rectification/smoothing unit for converting commercial AC power into DC power; a control unit for detecting a rate of variability of voltage of the commercial AC power, and generating a voltage compensating signal for compensating the rate of variability of the voltage; an inverting unit for varying a frequency of the DC power converted by the rectification/smoothing unit according to a voltage compensating signal of the control unit, and converting voltage of the converted DC power into fixed AC voltage; a first transformer for converting the fixed AC power outputted from the inverting unit into predetermined fixed voltage and current, and applying the predetermined fixed voltage and current to a filament of the magnetron; and a second transformer for converting the fixed AC voltage outputted from the inverting unit into predetermined fixed voltage. Herein, the high voltage transformer converts predetermined, fixed voltage outputted from the second transformer into high DC voltage, and outputting the converted high DC voltage of to the magnetron.

To achieve these and other advantages and in accordance with the purpose of the present invention, as embodied and broadly described herein, there is provided a method for controlling power of an electrodeless lighting apparatus using microwave including constantly maintaining voltage and current applied to a magnetron by compensating a rate of variability of inputted AC voltage when oscillation current applied to a filament of the magnetron is changed due to a change of the inputted AC voltage.

To achieve these and other advantages and in accordance with the purpose of the present invention, as embodied and broadly described herein, there is provided a method for controlling power of an electrodeless lighting apparatus using microwave including detecting a rate of variability of inputted AC voltage; and generating fixed AC voltage and current by compensating the detected rate of variability of the voltage. Herein, the electrodeless lighting apparatus generates microwave based on the fixed AC voltage and fixed current.

To achieve these and other advantages and in accordance with the purpose of the present invention, as embodied and broadly described herein, there is provided a method for controlling power of an electrodeless lighting apparatus using microwave including detecting a rate of variability of voltaged of inputted AC power, and generating fixed AC voltage and fixed oscillation current by compensating the rate of variability of the voltage; and converting the fixed AC voltage into DC power of high voltage, and outputting the converted high DC voltage. Herein a magnetron of the electrodeless lighting apparatus generates microwave based on the fixed oscillation current and the high DC voltage.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, an preferable embodiment of an electrodeless lighting apparatus using microwave capable of lengthened lifetimes of a magnetron by constantly maintaining voltage and current applied to the magnetron by compensating a rate of variability of input AC voltage when the input AC voltage is changed and thus current applied to a filament of a magnetron is changed, will now be described with reference to FIG. 3.

Figure 1:
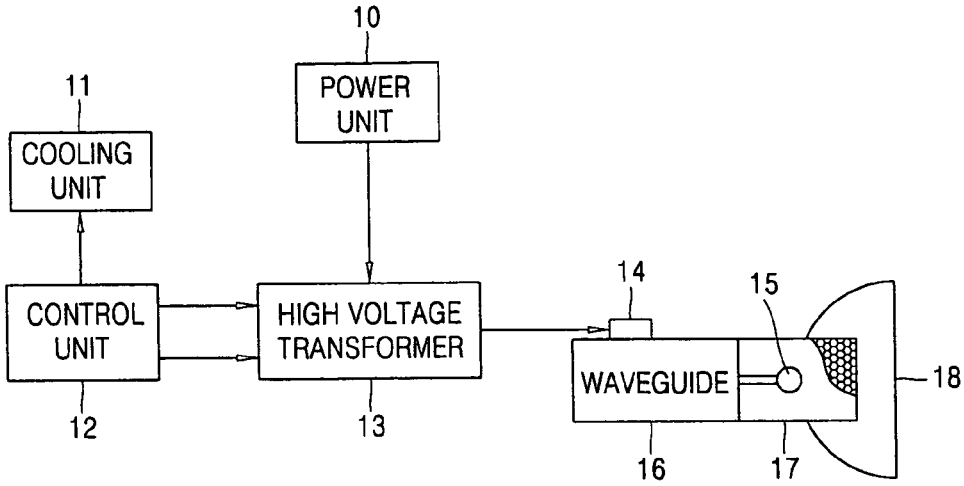
FIG. 1 CONVENTIONAL ART
FIG. 1 is a view illustrating a structure of an electrodeless lighting apparatus using microwave according to the conventional art.
Figure 2:
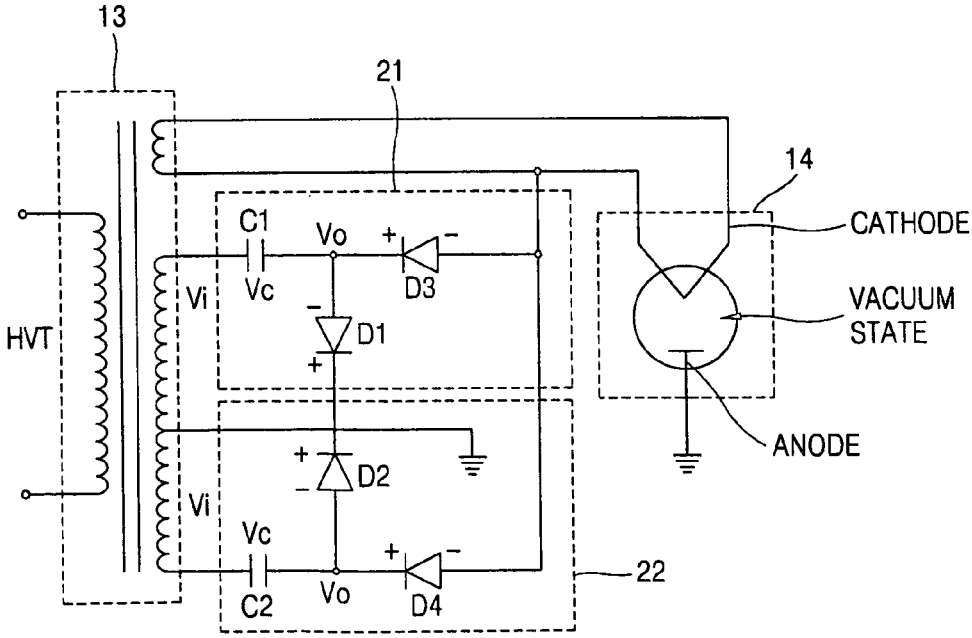
FIG. 2 CONVENTIONAL ART
FIG. 2 is a view illustrating a structure of an electrodeless lighting apparatus using microwave according to an embodiment of the present invention.
Figure 3:
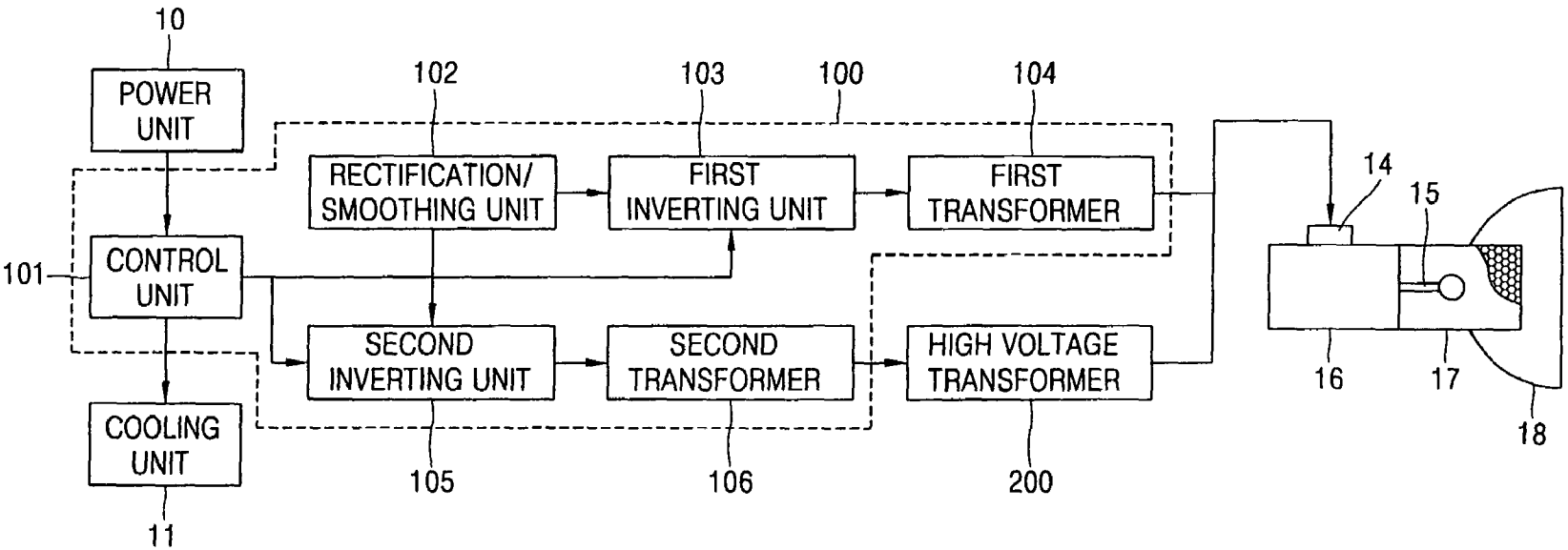
FIG. 3 is a block diagram of an electrodeless lighting apparatus according to the instant invention.

FIG. 3 is a block diagram illustrating a structure of an electrodeless lighting apparatus using microwave according to an embodiment of the present invention.

As shown in FIG. 3, the electrodeless lighting apparatus using microwave includes a power unit 10 for supplying commercial AC power; a power controlling unit 100 for detecting a rate of variability of voltage of the commercial AC power based on a predetermined reference voltage value (for example 220 Volt), and generating fixed voltage and fixed current (oscillation current) by compensating the detected rate of variability of the voltage; a high voltage transformer (HVT) 200 for converting the fixed voltage into high DC voltage, and outputting the converted high DC voltage; a magnetron 14 for generating microwave by receiving the high DC voltage and the fixed current (oscillation current); a waveguide 16 for inducing microwave generated from the magnetron 14; an electrodeless light bulb 15 for generating light by the induced microwave; a resonator 17 cutting off the microwave by covering the front of the electrodeless light bulb 15, and passing light emitted from the electrodeless light bulb 15 therethrough; a reflector for frontwardly reflecting the light passing through the resonator 17; and a cooling unit 11 for cooling-heat generated from the magnetron 14 and the high voltage transformer 13 according to a control signal.

The power controlling unit 100 includes a rectification/smoothing unit 102 for generating DC power by rectifying and smoothing commercial AC power supplied from the power unit 10; a control unit 101 for detecting a rate of variability of voltage of the commercial AC power, and outputting a voltage compensating signal for compensating the rate of variability of voltage; first and second inverting units 103, 105 for varying a frequency of DC power generated by the rectification/smoothing unit 100 according to the voltage compensating signal of the control unit 101, and converting the DC power into fixed AC power; a first transformer for converting the fixed AC power outputted from the first inverting unit 103 into a predetermined fixed voltage and fixed current, and applying the converted fixed voltage and current to the magnetron 14; and a second transformer 106 for converting voltage of AC power outputted from the second inverting unit 105, and outputting the predetermined, fixed voltage as converted to the high voltage transformer 200.

Hereinafter, operations of the power controlling unit 100 of the electrodeless lighting apparatus according to the present invention will now be described in detail.

First, the rectification/smoothing unit 102 generates DC power by rectifying and smoothing commercial AC power inputted from the power unit 10, and applies the generated DC power to the first inverting unit 103 and the second inverting unit 105 respectively.

The control unit 101 receives voltage of the commercial AC power, detects a rate of variability of the voltage of the commercial AC power, and applies voltage compensating signal for compensating the rate of variability of the voltage to the first inverting unit 103 and the second inverting unit 105. For example, on the assumption that the commercial AC voltage is increased by 11V when a predetermined reference voltage value is 220 Volt, the rate of variability of the voltage is increased by 5% (231V). At this time, the control unit 101 outputs a voltage compensating signal for decreasing the rate of variability of the voltage (5%=11V) to the first inverting unit 103 and the second inverting unit 105. Herein, if the rate of the variability of voltage (5%) is not compensated, current applied to a filament (cathode of magnetron) for operating the magnetron is increased thereby shortening lifetimes of the magnetron.

According to the voltage compensating signal of the control unit 101, the first inverting unit 103 and the second inverting unit 105 convert DC voltage generated by the rectification/smoothing unit 102 into fixed AC voltage by varying a frequency of the DC voltage, and output the converted fixed AC voltage to the first transformer 104 and the second transformer 106 respectively. For example, in order to compensating the rate of variability of the voltage (5%), that is, in order to decrease AC voltage of 11V, the first inverting unit 103 and the second inverting unit 105 convert DC voltage generated by the rectification/smoothing unit 100 into AC voltage of 220V by increasing a frequency of the DC voltage, and output the converted, fixed AC voltage (220V) to the first transformer 104 and the second transformer 106 respectively.

Thereafter, the first transformer 104 induces fixed voltage and current which are proportional to the predetermined number of windings by the fixed AC voltage outputted from the first inverting unit 103, and applies the induced fixed voltage and the induced fixed current to a filament of the magnetron 14. For example, preferable voltage and current which are applied to a filament of the magnetron are 3V and 10A (ampere) respectively, therefore the first transformer 104 receives fixed AC voltage (220V) outputted from the first inverting unit 103, generates fixed voltage of 3V and fixed current of 10A, and applies the generated fixed voltage and the generated fixed current to the filament of the magnetron 14. Herein, preferably, the number of windings of the first transformer 104 is set so that voltage of 3V and current of 10A are generated by receiving AC voltage of 220V. In addition, if voltage of 3*v* and current of 10A are applied to the filament of the magnetron 14 (cathode of magnetron), preferably, high DC voltage of 4 kV is applied to both sides of an anode and a cathode of the magnetron. That is, the present invention detects a rate of variability of a commercial AC power, compensates the rate of variability of the commercial AC power, and thus always supplies fixed oscillation current (10A) to a filament of the magnetron 14, thereby lengthening lifetimes of the magnetron.

The second transformer 106 induces fixed AC voltage (for example, AC 380V~400V) proportional to the predetermined number of windings by fixed AC voltage (AC 220V) outputted from the second inverting unit 105. At this time, the high voltage transformer 200 converts the fixed AC voltage (for example, AC 380V~400V) outputted from the second transformer 106 into high voltage having a DC component, and applies the high voltage (for example, 4 kV) having the DC component to the magnetron 14.

The magnetron 14 receives DC power of the high voltage and thus generates microwave. Herein, the microwave is induced to the electrodeless light bulb 15 through the waveguide.

The electrodeless light bulb 15 generates light by the induced microwave. Herein, the light is frontwardly emitted by the reflector 18.

As so far described, the present invention compensates a rate of variability of inputted voltage, and thus constantly maintains oscillation current supplied to a filament of a magnetron, thereby lengthening lifetimes of the magnetron. That is, when the inputted AC voltage is changed, and thus oscillation current supplied to a filament of the magnetron is changed, voltage and current which are applied to the magnetron are constantly maintained by compensating a rate of variability of the inputted AC voltage, thereby lengthening lifetimes of the magnetron.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting apparatus using microwave comprising:

a power controlling unit for detecting a rate of variability of voltage of inputted AC power, and generating fixed AC voltage and fixed oscillation current by compensating the rate of variability of the voltage;

a high voltage transformer for converting the fixed AC voltage into high DC voltage, and outputting the converted high DC voltage; and a magnetron for generating microwave based on the fixed oscillation current and the high DC voltage, wherein the power controlling unit comprises:

a rectification/smoothing unit for converting commercial AC power into DC power;

a control unit for detecting a rate of variability of voltage of the commercial AC power, and generating a voltage compensating signal for compensating the rate of variability of the voltage;

an inverting unit for converting voltage of the converted DC power into fixed AC voltage by varying a frequency of the DC power converted by the rectification/smoothing unit based on the voltage compensating signal of the control unit, a first transformer for converting the fixed AC power outputted from the inverting unit into predetermined fixed voltage and current, and applying the predetermined fixed voltage and current to a filament of the magnetron; and a second transformer for converting the fixed AC voltage outputted from the inverting unit into predetermined fixed voltage, wherein, the high voltage transformer converts predetermined fixed voltage outputted from the second transformer into high DC voltage, and outputting the converted high DC voltage to the magnetron.

2. A method for controlling power of an electrodeless lightina apparatus using microwave comprising:

detecting a rate of variability of inputted AC voltage, and generating fixed AC voltage and fixed oscillation current by compensating the rate of variability of the voltage; and converting the fixed AC voltage into high DC voltage, and outputting the converted high DC voltage, wherein a magnetron of the electrodeless lighting apparatus generates microwave based on the fixed oscillation current and the high DC voltage, wherein said generating the fixed AC voltage and the fixed oscillation current comprises;

converting inputted commercial AC power into DC power;

detecting a rate of variability of voltage of the commercial AC power, and generating a voltage compensating signal for compensating the rate of variability of the voltage;

converting the converted DC power into fixed AC power by varying a frequency of the converted DC power based on the voltage compensating signal; and converting the converted fixed AC power into predetermined fixed voltage and current, and applying the predetermined fixed voltage and current as converted to a filament of the magnetron.

* * * * *